US005330198A

United States Patent [19]

Dinhofer

[11] Patent Number: 5,330,198

[45] Date of Patent: Jul. 19, 1994

[54] TOY GLIDER TARGET GAME

[76] Inventor: Milton J. Dinhofer, 32 Skillman St., Roslyn, N.Y. 11576

[21] Appl. No.: 13,738

[22] Filed: Feb. 4, 1993

[51] Int. Cl.[5] ..... A63H 27/14

[52] U.S. Cl. ..... 273/317; 446/65

[58] Field of Search ..... 273/317, 348; 124/20.1; 446/61, 62, 63, 64, 65

[56] References Cited

U.S. PATENT DOCUMENTS

| | | | |
|---|---|---|---|
| 2,426,437 | 8/1947 | Cole et al. | 446/65 |
| 2,644,271 | 7/1953 | Shapiro | 446/65 |
| 3,009,700 | 11/1961 | Dolega | 273/348 |
| 3,068,612 | 12/1962 | Simpson | 446/65 |
| 3,246,425 | 4/1966 | Miller | 446/61 |
| 3,733,737 | 5/1973 | Goodman | 446/65 |
| 4,064,647 | 12/1977 | Lemelson | 446/65 |
| 4,332,103 | 6/1982 | Shulman | 446/64 |
| 4,997,401 | 3/1991 | Rose et al. | 446/64 |
| 5,078,639 | 1/1992 | Kippen | 446/61 |

*Primary Examiner*—William H. Grieb

*Attorney, Agent, or Firm*—Helfgott & Karas

[57] ABSTRACT

A flying glider game has a lightweight glider, a launcher and a target attached to the launcher or hand-held. The glider includes a U-shaped planar wing with elongated outwardly projecting side stabilizers, rear ailerons, a rounded nose with an upwardly curved leading edge, and a rigid nosepiece connected thereto. The nosepiece is provided with a finger grip, a rubber band hook, a rectractable trigger pin, wing fasteners and adjustable weight fasteners.

21 Claims, 3 Drawing Sheets

FIG. 2.
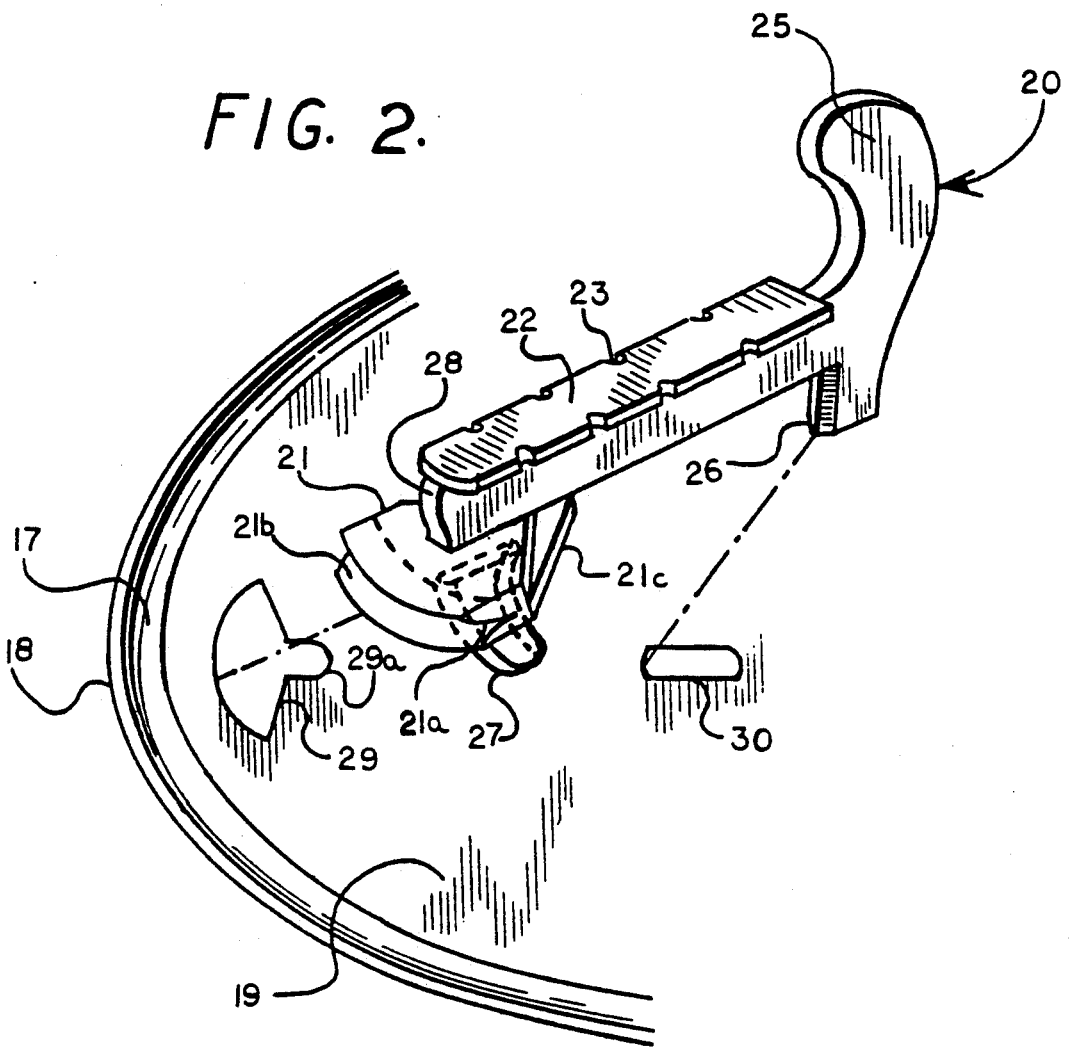
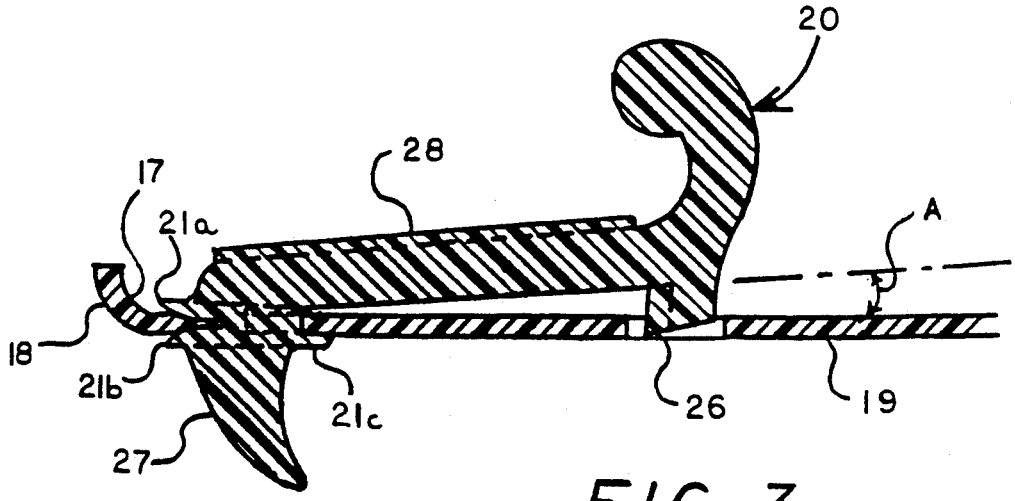
FIG. 3.

TOY GLIDER TARGET GAME

BACKGROUND OF THE INVENTION

1. Field of Invention

This invention relates to a toy glider and in particular to an ultra-light weight toy glider that can be catapault launched wherein the user, using eye and hand coordination, develops a skill utilizing the guidance control of the launcher and the aerodynamics of the glider to link the glider in flight to a hand held target or land it on a preselected target. The device relates then to a game of skill as well as a toy.

2. Description of Prior Art

Light weight toy gliders go back to the first folded paper gliders patented at the turn of the century. They are still made and flown for fun today by both adults and children. More recent prior art includes expanded styrofoam in place of paper or balsa wood and it has been employed with basically the same flying qualities as the two, however, styrofoam has very poor shear strength, very poor tensile strength and very poor compressive strength as compared to paper or balsa wood. To overcome these problems prior art shows a preponderance of weight adding and bulk adding built up surfaces. The distinction between a light weight glider and an ultra-light weight glider is based on their comparitive weights. Prior art lightweight gliders start at 1 once and up. 1 once equals 28.4 grams. An ultra-light weight glider has a maximum weight of about 4.0 grams and can be less.

Launching devices for gliders also go back to the turn of the century. They all have two basic objectives: a) get the glider to flying speed before it leaves the launcher. b) get it to travel as far as possible after it leaves the launcher. No consideration is given to accurately controlling the trajectory other than to indicate it will loop, spiral or boomerang.

One such early catapaulted glider is shown and described in U.S. Pat. No. 2,644,271 issued Jul. 7, 1953 to W. J. Shapiro for a "Toy Glider and Launching Platform" in which a heavy paper, or the like, body is reinforced by doubling it and laminating the two bodies together with glue in order to absorb the tensile and shearing strength of the resilient rubberband launching device. The wings also are altered to rest on the platform holding the glider upright. The glider nosepiece is a large heavy syringe shaped piece of soft rubber added to the body. The catapault is a simulated aircraft carrier flight deck rubberband powered and finger released by pushing the glider tail and stabilizers up and away from the platform.

Another such catapaulted glider is shown and described in U.S. Pat. No. 4,064,647 issued Dec. 27, 1977 to J. H. Lemelson for a "Catapault Launched Model Glider" in which an expanded styrofoam flying wing type body utilizes a tail trigger locking insert imbeded in the rear of the built up styrofoam body and a separate front launching insert imbeded in the front of the built up body with a rather large heavy molded snubnosed nosepiece added to it. The catapault is a two handed rifle holding a stick mounted rubberband. The glider is launched by pushing the tail up and away from the gun.

Another such launchable glider is shown and described in U.S. Pat. No. 4,332,103 issued Jun. 1, 1982 to L. Shulman for a "Model Aircraft Glider" in which an expanded styrofoam flying wing type body utilizes a front rubberband hooking insert in a heavily built-up styrofoam body with a large, heavy foam rubber bumper added to it. The catapault is a stick mounted rubberband.

Another such launchable glider is shown and described in U.S. Pat. No. 4,997,401 issued Mar. 5, 1991 to H. Rose et al. for an "Aerial Toy" in which a nose piece of heavy plastic fastens to the entire length of the leading edge of a rather large, thick ($\frac{1}{8}$ to $\frac{1}{4}$ inch), flat piece of expanded styrofoam board. The catapault is a stick mounted rubberband.

Other pistol type rubberband powered catapaults are shown in U.S. Pat. No. 2,426,437 issued Aug. 26, 1947 to H. E. Cole et al. for a "Toy" and U.S. Pat. No. 3,068,612 issued Oct. 23, 1961 to R. R. Simpson for a "Self-controlled Toy Airplane". Both utilize sliding carriages and long length barrels to launch a heavy weight glider.

A non-catapaulting glider showing prior art is described in U.S. Pat. No. 3,246,425 issued Apr. 19, 1966 to C. Miller, entitled "Aerial Glider Toy" disclosing a thick expanded styrofoam planar wings extending from a full length expanded styrofoam non-lifting fuselage, a pair of verticle non-lifting tail fins, a single fixed molded aileron at the rear and a heavy sliding metal clip and heavy non-lifting snub-nose in front to balance all the non-lifting tail weight.

Another non-catapaulting glider is shown and described in U.S. Pat. No. 3,733,737 issued May 22, 1973 to H. Goodman entitled "Toy Airplane", such patent disclosing a thin planar delta shaped wing having parallel top and bottom surfaces, moveable non-locking ailerons and moveable non-locking side stabilizers fastened to a full length tube fuselage.

Another non-catapaulting flying wing type glider is shown and described in U.S. Pat. No. 5,078,639 issued Jan. 7, 1992 to S. Kippen entitled "Model Aircraft Glider", such patent disclosing thick contoured wings with a planar undersurface extending on either side of a large heavy bulbous nose extending in front of built up weighty wings and a full length fuselage all of expanded styrofoam.

In a toy glider of the present invention, the safety features of the glider and the launcher, the accuracy of the glider flight trajectory, the vastly improved sustained height of flight, the compactness of the glider flight surfaces, the compactness of the launcher, the accuracy of the launcher, the durability of the structure of the glider when used, the stability of the flight control features of the glider when in use, the stability and efficiency of the launching control features of the launcher enable the launcher and glider to be used safely and easily as a toy for children or as a game when used in conjunction with a target.

SUMMARY OF THE INVENTION

It is an object of the present invention to provide a flying game in the form of a small, light weight glider, a compact launcher therefore and a target for aerial docking of the glider when properly aimed. In one form the glider, simulating a space shuttle, is made of a very thin unitary planar wing of uniform thickness and density throughout with a round upturned leading edge extending horizontally around to either extreme of the sides to two fixed angle side stabilizers running parallel to and equidistant on either side of the longitudinal axis, with self-locking ailerons on the trailing edges and forward apertures centrally located immediately behind the upturned leading edge for connecting thereto the unitized rigid plastic nosepiece member consisting of the elastic hooking member, the retracting trigger pin engaging member, the finger gripping member, the wing fastening member, the load distributing member, the aperture closing members, and the serrated weight locking member. The adjustable weight consisting of two attached toy figures seated side by side with an indented T-slot between them, the slot clipping into the selected serration on the nosepiece depending on desired flight pattern, additional figures can be added to obtain different aerodynamics results. In particular form the launcher, simulating the main liquid fuel tank and solid rocket boosters of a space shuttle launcher, is composed of a short length of wide channel guideway, concave side up, configured to contain the glider rubberband hook and the rubberband, elongated slots on each side of the forward inside lower portion configured to wedge the rubberband in place allowing infinite tension adjustments and uninterrupted path of launch, an extended portion in front of the rubberband locking slots to prevent the rubberband after launching from falling below the guideway and enabling it to automatically return to an upright position for fast reloading, the upper outside edges of the channel are integrally formed somewhat extended horizontal flat surfaces to maintain proper glider orientation up to the instant of launch, located below and to the rear is a hollow pistol grip and trigger, the trigger means pivotally mounted inside the channel urges a broad V shaped projection to slide up above the horizontally extended flat upper edges when the trigger is released and down towards the edges when the trigger is pulled, the trigger engaging member on the glider is contoured to slide to the center of the V when meshed together under rubberband tension, the alignment of the two maintains the glider upright and away from the launcher. When the trigger is pulled the glider moves down with the trigger to a release point stopping devise that holds the glider fractionally away from the launcher as it pushes the glider locking member off the V projection. The V projection, just before release, loses its ability to hold the glider properly, at this point the glider tips fractionally contacting the horizontal flat surface and maintaining desired orientation with minimum contact pressure. The trigger engaging member on the glider retracts into the wing as the trigger is pulled and when launched avoids snagging the rubberband as it passes it. The inertia at the instant of launch causes the glider to return to its desired horizontal level position breaking contact with the launcher without inertial over-correction. The channel is linearly calibrated to indicate rubberband tension and proper position of glider when cocking. In particular form the target is composed of a series of 3 docking bays centrally oriented to each other and each progressively smaller in height and width than the other and somewhat behind each other, the larger bay to the front stepping down to a smaller middle bay behind it stepping down to the smallest bay in the rear then leading to a stopper that can simulate a space station docking module. The steps between the bays are spaced far enough apart and high enough to retain the glider in the position that it lands with means of scoring increasing at each step as the glider penetrates deeper through to the smallest bay to the stopper. Extending to the rear behind the stopper is a spine member with a clip affixed to it in upright position and configured to clip into the hollow of the launcher pistol handle locking therein until a button on the handle is pressed to release it. The larger bay of the target extends forward of the pistol and beneath the launching platform. The rear spine member that clips to the pistol handle along with the rearward extending horizontal edges of the launcher form a tripod that maintains the launcher, glider and target in a realistic upright countdown launching position when not in use.

It is a principal object of this invention to provide a new and improved toy glider.

The present invention provides a new and improved launcher for an ultra-lightweight glider.

This invention also provides a target to which a glider when launched on a predetermined trajectory can rondezvous with while still in flight and land on or in and be scored.

This invention provides an improved means for attaching a glider to a launcher.

According to this invention, a new and improved ultra-lightweight toy glider is provided that can be launched at relatively lower speed from a resilient rubberband, or the like, powered launching device.

According to this invention, a new and improved toy glider is provided that is not composed of a heavily weighted front or a pointed nose or a snub nose or weighted flying leading edges that can accidentally causing damage or pain to anyones eye or face if struck or if struck on any other part of the body when power launched.

A new and improved safety toy glider is provided that is ultra-lightweight which can be power launched in confined areas such as a bedroom without damage to surrounding windows, furnishings and artifacts or outdoors where there are nearby trees and foliage without damage to foliage or danger of landing in a tree.

A new and improved safety nosed toy glider is ultra-lightweight which can be power launched in any confined area wherein impact with an obstacle or a purposeful target will not cause damage to the glider.

A new and improved safety nosed toy glider simulates the flight controls and resulting flight patterns of a full size passenger carrying glider and is somewhat similar in appearance and engineering to a space shuttle. Although it can also simulate other types of launching devices and gliders.

A new and improved ultra lightweight safety nosed toy glider is provided that when power launched from a standing position in a standard room with an eight foot high ceiling will return with great precision to the launcher at the original height of launch or higher without hitting the ceiling.

A new and improved toy glider when power launched has a degree of control that enables it to follow the same trajectory, with great precision, each time it is accurately aimed and launched, whether launched to go in a straight line, a loop or an orbit.

A new and improved toy glider can be readily and repeatedly made to return to the same desired location and land on, dock with or enter a relatively small target or target opening, while still flying.

A new and improved toy glider when aimed and power launched does not have to be aimed directly at the target in order to hit it.

An improved toy glider is provided with less projected wing surface to snag or interrupt its trajectory.

In an improved toy glider, once said ailerons are set they are locked precisely in position, and will not change position due to plastic memory or due to the inertia of launch and impact and do not have to be reset after each launch, without said locking means adding additional non-lifting weight to the glider.

In the toy glider a minimum of non-lifting surfaces or non-lifting controls and non-lifting structure extend to the rear of the center of lift substantially decreasing the nose weight needed for aerodynamic balance resulting in substantially decreased weight and increased lift.

The glider has a slower stalling speed and a fast recovery from a stall.

The ultra-light toy glider is provided with substantially increased lift extending in front of the nosepiece and that can lift a relatively heavy nosepiece and at the same time sustain the desired ultra-light flight pattern.

In the toy glider the forward aerodynamic balancing weight is moved as far back as possible without going back past the center of lift.

The ultra-light toy glider incorporates a structural frame that maintains its planar flying surface under conditions of use without adding weight or non-lifting surfaces.

The toy glider has in one unitized compact aerodynamic rigid plastic nosepiece insert all the required components for attaching the nosepiece to the glider, loading and cocking the glider on the launcher, launching the glider, means for aerodynamic weight adjustment and locking in position of the weight, means for distributing its inertial load on launch and impact safely against the styrofoam, means for retracting the trigger engaging pin upon launch to prevent rubberband snagging and means for preventing the stresses involved in loading and launching from being applied to the sensitive foam structure.

The ultra-lightweight toy glider can be launched from a rubberband powered launching device having said nosepiece attached to said wing entirely in front of the combined center of lift of said wing and said nosepiece.

In the safety-nosed toy glider the rigid weighted nosepiece is attached behind the soft leading edge of the glider.

The ultra-lightweight safety nosed toy glider is provided with means to increase the lift of the added weight of said nosepiece without adding non-lifting weight.

The toy glider can be launched from a rubber band powered launching device without any of the loading tension of said rubberband, when pulling against the rubberband hooking devise and when pulling against the finger gripping projection and when pulling against the trigger engaging pin, being transmitted to the non weight bearing foam surfaces while loading and launching, thereby preventing damage and distortion thereto.

The ultra-light weight safety nosed toy glider has provisions in the nosepiece for reducing the length of launching device employed.

The toy glider can maintain a circular orbiting trajectory.

In the glider when produced in large quantities, each unit of the assembly line will have substantially the same anticipated flight characteristics.

The toy glider in production will ensure that the distribution of weight, balance and density of the materials can be more accurately controlled.

The ultra-light safety nosed toy glider which is of sturdy weight reducing construction, simple of assembly, easy to use and not likely to get out of order.

A rubberband powered, or the like, toy glider launcher is provided, which is adapted to efficiently launch an ultra-lightweight glider with extreme accuracy without any danger of the glider unexpectantly altering course and hitting existing obstacles and having said glider when aimed and launched consistently follow the same trajectory to a predetermined position where it can be caught on a target.

The rubber band powered toy glider launcher can launch an ultra-light weight glider incorporating the triggering and aiming means of a pistol with the instant, free flying, straight line follow through acceleration of a stick mounted rubberband launcher or sling shot.

The rubber band powered toy glider launcher can launch an ultra-light weight glider accurately with a minimum length of rubberband stretch requiring a shorter length of said launcher when the glider is loaded on the launcher and ready to be launched.

The rubberband powered toy glider launcher is provided with a triggering mechanism that requires less launcher length to activate the trigger.

The rubber band powered toy glider launcher simulates the main liquid fuel tank and solid rocket boosters used to launch real present day space shuttles. The launcher can also simulate other propelling devices.

The rubber band powered toy glider launcher can launch an ultra-lightweight glider accurately without any of its parts obstructing the path of launch of the glider or causing friction to the forward motion of the glider.

The rubberband powered toy glider launcher can launch an ultra-lightweight glider, accurately with means to maintain the desired wing and body orientation necessary for precision flying through the entire triggering process and instantly thereafter.

The toy has new and improved means for maintaining the launching position of the rubberband with relation to the longitudinal axis of the glider to prevent premature nose-lift or nose-dive.

The rubberband powered toy glider launcher can launch a toy glider accurately and return the rubberband back to loading position for quick and easy reattachment to the glider when reloading.

The rubberband powered toy glider launcher can launch a toy glider accurately with means for infinite adjustment of rubberband tension without difficulty.

In the rubberband powered toy glider launcher the rubberband is protected from chaffing when used.

The rubber band powered toy glider launcher can launch a glider accurately with means for readily meshing the glider trigger engaging pin to the launcher trigger pin.

The rubber band powered toy glider launcher can launch a glider accurately with means to hold the glider in parallel alignment longitudinally and laterally with the launcher without any of the surfaces making contact with said launcher excepting the trigger engaging pin and the rubberband.

The rubberband powered toy glider launcher can launch a glider accurately with means for holding the glider in a fixed position away from the launcher when the trigger pin is activated.

The rubberband powered toy glider launcher can launch a glider accurately with means for returning the glider to parallel planar alignment with the launcher and out of contact with the launcher except for the rubberband the instant after launch.

The rubberband powered toy glider launcher can launch a glider accurately with means for containing the compressing rubberband within its body and out of the direct line of launch of the glider at all instances of launch.

The rubber band powered toy glider launcher is provided with markings thereon to calibrate the tension of the rubberband and location of trigger engaging pin when said pin is concealed.

The rubber band powered toy glider launcher can launch a glider accurately using standard, light weight, household rubberbands.

Means are provided to store the launcher, attached with the glider without damaging the glider.

The rubberband powered toy glider launcher has means for easily attaching thereto and detaching therefrom a target or a gaming devise to manipulate the launcher and still be hand held and fired.

The rubberband powered toy glider launcher is sturdy of construction, easy to produce, simple of operation, consistent in its launching features, easily manipulated and not likely to get out of order.

A target for the glider to land in or on is also provided.

A lightweight target can be hand held or readily attached to the launching device, not interfering with the aiming and launching of the glider.

The lightweight target can be readily removed from the launcher when no longer needed.

Yet another object of this invention is to provide a lightweight target that is easy for the user to manipulate to align the target center with the returning glider flight trajectory using hand and eye coordination to increase scoring ability.

The lightweight target simulates any landing situation that a real glider or space shuttle might confront. The target can also simulate other target means.

It is another object of this invention to provide a lightweight target that has an entranceway for the glider to fly into. The entranceway becoming progressively smaller as the glider flies deeper into the target. Target scoring depending on depth of penetration.

Step-like obstructions in the flight path of the glider are suggested as a means for stopping and retaining a glider at its first contact with an obstruction and indicating the score at that obstruction, the score increasing as the glider penetrates deeper through to the smallest centrally located opening in the target.

A safe storage place for the gliders when not in use is provided.

Still a further object of this invention is that the lightweight target has a supporting leg extention located at the very rear that allows the back of the launcher and target, when attached, to act as a tripod when not in use and when placed on a shelf or a desk, to point launcher and target upwards simulating a real space shuttle with gantry crane in countdown position and at the same time requiring less storage space.

A new and improved lightweight target is sturdy of construction, easy to produce, simple to attach or hold with positive glider holding means when landed, allowing easy scoring, and allowing easy retrieval of the glider.

The target which is sturdy of construction, is easy to produce, simple of operation, easily manipulated and not likely to get out of order.

Other and further important objects of the invention will be apparent from the disclosures in the accompanying drawings and following specifications.

The invention in preferred form is illustrated in the drawings and hereinafter more fully described.

BRIEF DESCRIPTION OF THE DRAWINGS

FIG. 2 is a top view of the front portion of the glider forward of the center of lift of the wing and showing an unassembled perspective view of the glider nosepiece with relation to the apertures in the front of the glider.

FIG. 3 is a crossection of the front of the glider showing the nosepiece in position.

DETAILED DESCRIPTION OF THE INVENTION

Figure 1:
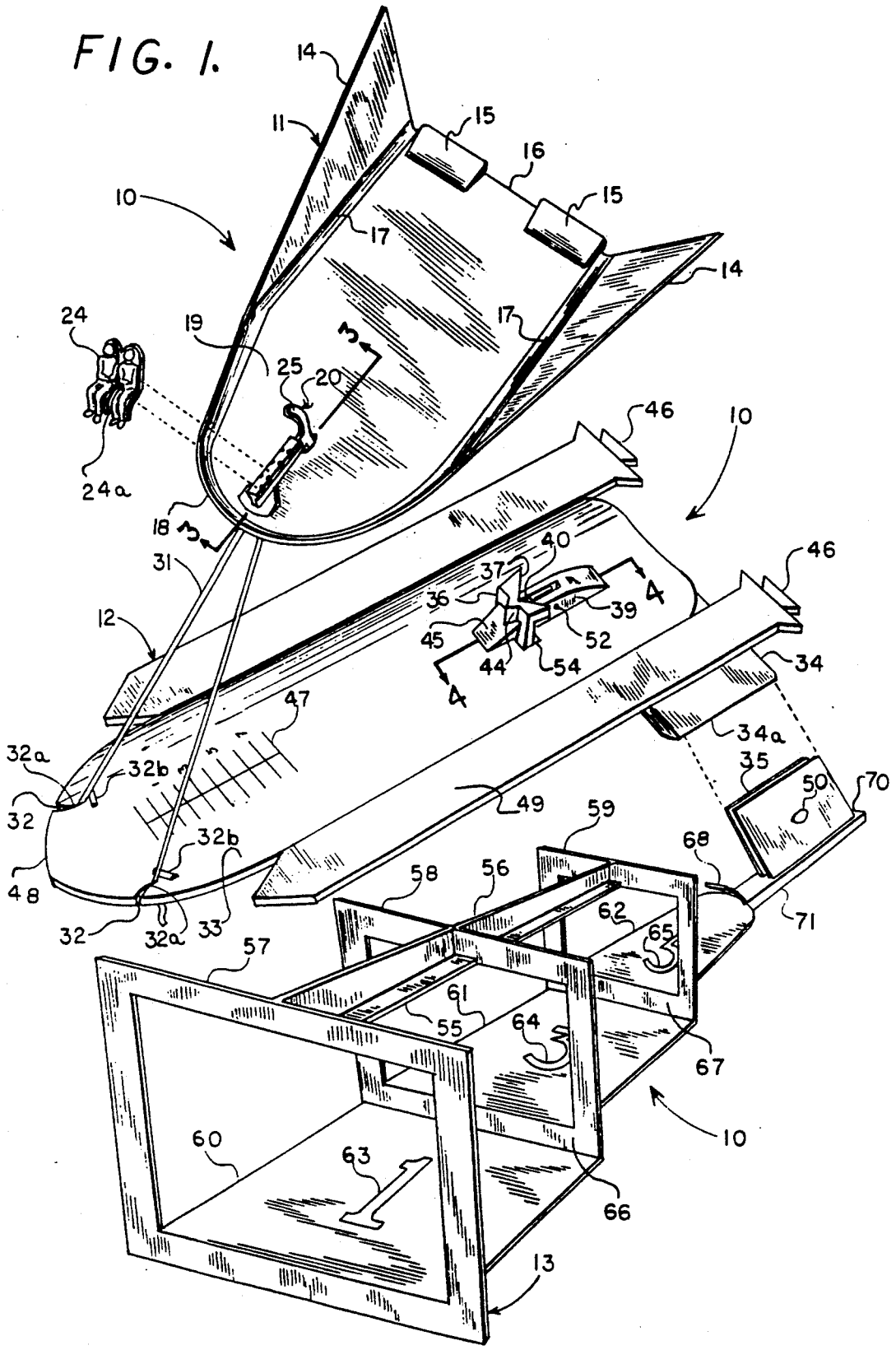
FIG. 1 is a perspective view illustrating a glider and a launcher in accordance with the invention and an associated attachable target.

In FIG. 1 are shown details of a flying game, generally designated 10 comprising an ultra-light toy glider 11, shown extended from a looped rubberband 31 attached at points 32*a* to the launching device 12, the launching device or launcher 12 is a portable hand-held unit comprising a short channel or upwards open concave barrel 33 having a hollow pistol grip 34 depending downwardly therefrom, clipping into the hollow of the pistol grip 34*a* is a matching male clip 35 attached to the target 13. When clip 35 is inserted into the hollow pistol grip 34*a* it clips the target 13 firmly to the launcher 12.

While the unitary glider wing 19 is preferably thermo-heat formed from thin flat extruded sheet styrofoam it can also be molded of expanded styrofoam with similar aerodynamic features. The density control of the extruded sheet styrofoam is superior to that of expanded styrofoam giving more even weight distribution and more consistant and better flight control to the glider. The nosepiece 20 on the glider is molded in one piece of a rigid high impact plastic material such as polystyrene. The launcher 12 and the target 13 may be molded in four or more sections of any rigid somewhat resilient high impact thermoplastic material.

The glider 11 is composed of a lifting body wing 19 and a cockpit type nosepiece 20, with means of fastening toy figures 24 adjustably thereon. The wing 19 is of a narrow U-shaped configuration with planar top and bottom surfaces. The leading edge 18 is a large radius forming the round bottom of the U-shaped configuration. The round nose, unlike the sharp nose of a delta wing glider, upon contact with a persons eye substantially bridges the bone around the eye reducing the effect of the impact. The narrow U-shaped configuration allows the glider to fly and land in more confined areas and requires a much smaller lighter target to score with in the game mode. The round nose gives the nose of the glider additional lift to match the lift of the rear tail section of the wing substantially decreasing the probability of the glider stalling at any speed. The round nose gives additional lift allowing an increase in the concentrated weight of the added nosepiece. The stabilizers 14, thermoformed integrally from the same sheet of styrofoam as the wing 19, fletch back along the parallel outer sides of the U configuration substantially parallel to each other and to the longitudinal axis. The stabilizers 14 angle outwards and upwards as they go from the leading edge 18 to the trailing edge 16 of the wing 19. The angle of incline of the stabilizers 14 is such that the lift of the stabilizers match the weight of the stabilizers when in flight, approximately 45 degrees in this case. The angle varies with the density and thickness of the foam material used. The greater length of the stabilizers 14 as a percentage of the length of the glider increase horizontal flight stability of the glider and also substantially increase the structural integrity of the glider.

The numeral 17 denotes a continuous upwardly thermoformed fillet running from the trailing edge 16 at the right side of the wing 19 along the U configured perimeter to the round leading edge 18 and around the leading edge to the left side of the wing 19 and back to the trailing edge 16 again. The fillet 17 combined with the stabilizers 14 provide a structural unitized U frame capable of maintaining the wing 19 in its desired planar shape during general use. The upward formed fillet 17 acts as a flexible bumper when the glider 11 collides with an obstacle. The outward formed fillet 17 provides additional lift to the nose of the glider 11. The fillet 17 is also the meeting point of the stabilizers 14 and the wing 19 holding the stabilizers 14 at a fixed angle to the wing 19. The fillet 17 being thermoformed from the same sheet of material as the glider 11 does not add non-lifting weight to the glider while performing its functions.

A pair of spaced ailerons 15 are formed into the lateral outer ends of the trailing edge 16, the length, width and upward angle of the ailerons 15 determine the trajectory of the glider by maintaining the wing 19 inclined upwards during flight. The wing 19 is also maintained inclined upwards during flight by the upward formed fillet 17 along the leading edge 18.

FIG. 2 shows a pair of aligned apertures 29 and 30, along the longitudinal axis and just behind the fillet 17 at the leading edge 18 of the wing 19. The nosepiece member 20 is in position to be inserted into the apertures.

As better illustrated in FIGS. 2 and 3 the nosepiece member 20 has molded integrally therewith along its generally thin planar vertical surface a finger gripping hook 25 extending upwards from the its rear, a trigger engaging pin 26 extending downwards from a point below the finger gripping hook 25, a short length of T-configured rod 28 extending forwards from the finger gripping hook 25 to a rubberband gripping hook 27 extending downwards from the front and hooking rearwards. The outer edges of the top 22 of the T-configured rod 28 are serrated at intervals with adjacent notches 23. Transversely extending from the leading edge of the nosepiece 20 and in line with the bottom edge of the T rod 28 is a forward opening clip 21 with the top surface of the clip **21*a* and the bottom surface of the clip 21*b* curving in towards each other and extending rearwards above the rubberband hook 27 and meeting in a wedge, the lower surface of 21*b* extends rearwards forming appendage 21*c*. The clip 21 is slightly inclined, angle A, to the longitudinal axis of the T rod 28. The small figures of astronauts 24, FIG. 1 have a T-shaped slot 24*a* separating them. The T-slot matches the T rod on the nosepiece and clips to it snuggly locking on the serrations 23** preventing the figures from sliding back and forth on launch and landing or collision.

FIG. 3 further illustrates the insertion of the nosepiece 20 into the wing 19, the smaller slot **29*a* allows the rubber band hook 27 to be inserted into the aperture 29 first then the beveled edges of the clipping surfaces 21*a* and 21*b* encompass the top and bottom surface of the leading edge of aperture 29 and wedge tightly to the foam wing 19 when pushed forward into place. The appendage 21*c* is larger than the wedge shaped aperture opening 29 and 29*a* and when pressed into the aperture the styrofoam around the aperture compresses allowing the appendage 21*c* to pass through it. Once the appendage 21*c* passes through the aperture 29, the styrofoam with plastic memory returns to its original size wedging in the apendage 21*c* and encompassing it at its trailing edges locking the nosepiece 20 to the wing 19 and preventing it from any motion forwards, backwards or twisting. The trigger engaging pin 26 extending somewhat loosely through the aperture 30** helps maintain the nosepiece in alignment with the longitudinal axis of the wing.

The clip 21 being slightly inclined to the axis of the nosepiece 20 causes the T-rod section 28 to angle upwards away from the wing 19 as it projects rearwards. The angle A of the incline is such that the bottom of the trigger engaging pin 26 is flush to the bottom surface of the wing 19 when the glider is in flight.

FIG. 1 shows the launcher 12 with the rubberband 31 attached through wedge openings 32 at points **32*a* out of the way of the launch path of the rubberband hook 27 and away from its own line of compression allowing an uninhibited sling shot effect on launch. Rounded nubs 32*b*** control the height of the rubberband with reference to the launcher and also prevent chaffing of the rubberband when under tension.

Indicated at the front of the launcher and behind the rubberband attachment points are a series of ruled lines 47 running transversally to the longitudinal axis of the barrel 33. These calibration lines enable the user to calibrate the proper slack position of the rubberband for repeat accurate launch tension. The extended leading edge 48 of the barrel prevents the slack in the rubberband after launching from wrapping around the bottom of the barrel and snagging. The rubberband hits the extended edge 48 and bounces back into loading position.

Extending from the sides of the barrel 33 are horizontal guidance surfaces 49. The trailing edges 46 of the horizontal guidance surface 49 are of a length that extends past the tail of the glider when loaded and acts as a tripod enabling glider 11 when loaded on the launcher 12 and when connected to the target 13 to be stored in an upright position with the launcher 12, the glider 11 and the target 13 pointing upwards towards the ceiling without the glider tail resting on the supporting surface and simulating the prelaunch position of a space shuttle.

Mounted to the rear of the barrel 33 is the triggering mechanism.

Figure 4:
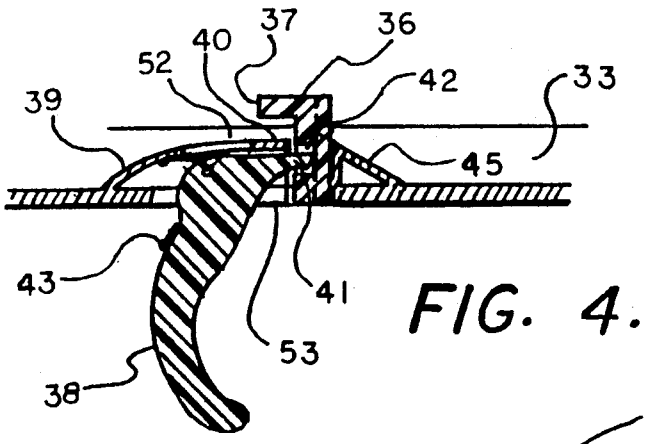
FIG. 4 is a crossection of the trigger mechanism in the launcher.

FIG. 4 Illustrates the triggering mechanism consisting of the trigger 38 and the trigger pin 36. When the trigger 38 is pulled back through the opening 53 in the barrel it pivots on its fulcrum 52 causing lever point 41 projecting through the trigger pin aperture 42 in the trigger pin 36 to pull the trigger pin 36 and its V shaped guidance piece 37 down through its opening 54 in the barrel while the trigger 38 is compressing the spring 43. When the trigger 38 is released the spring 43 pushes the trigger back to loading position which in turn acts on the lever point 41 returning the trigger pin 36 to its original position ready to be loaded again. The trigger 38 is prevented from being pulled too far back by either contacting the pistol grip 34 or contacting the launcher barrel 33. The trigger 38 is prevented from moving too far forward by its contacting the trigger engaging pin stopper 40.

The trigger and the spring is held in place by a pair of end brackets 39, FIG. 1. The end brackets 39 meet in a smooth curve at the top, preventing the trigger engaging pin 26 from snagging during the loading process and helps guide the engaging pin to the trigger guidance piece 37 on the trigger pin 36. The trigger pin is held in place by retainer bracket 45. The V slot on 45 aligns with the V strip 44 on the trigger pin keeping it in vertical alignment through its entire operation.

When the trigger engaging pin 26 on the glider is placed behind the guidance piece 37, the pull of the rubber band 31 against the rubberband hook 27 causes pin 26 to slide to the center of the V. The V shape of the leading edge of the trigger engaging pin 26 nests with the V shape of the trigger guidance piece 37 holding the glider 11 in proper alignment and out of contact with the launcher 12.

When the trigger 38 is pulled back and the trigger pin 36 moves down it pulls the glider 11 down until the trigger engaging pin 26 hits the trigger engaging pin stopper 40. The height of the trigger engaging pin stopper 40 is set so that the glider 11 is at its closest point to the launcher without making contact, approximately 1/32 to 1/16 of an inch.

When the trigger 38 is pulled to just before the release point the nested V's of the trigger pins can no longer retain the glider in perfect alignment with the launcher and some part of the glider comes to rest on the smooth horizontal edges 49 of the launcher. Upon release, the rubber band 31 slingshots the glider forward with an inertia that takes the glider instantly out of contact with the edges of the launcher and back into almost perfect non-contact alignment during the launch. The rubber band anchor points 32*a* along with the lips 32*b* behind them control the angle of pull of the rubber band on launch. The desired direction of launch is the glider accelerating parallel to the barrel of the launcher. If the glider noses down on launch the lips are raised. If the glider noses up on launch the lips are lowered. When the nosepiece hook and the rubber band lip heights are set during production, no further adjustment is necessary.

Figure 5:
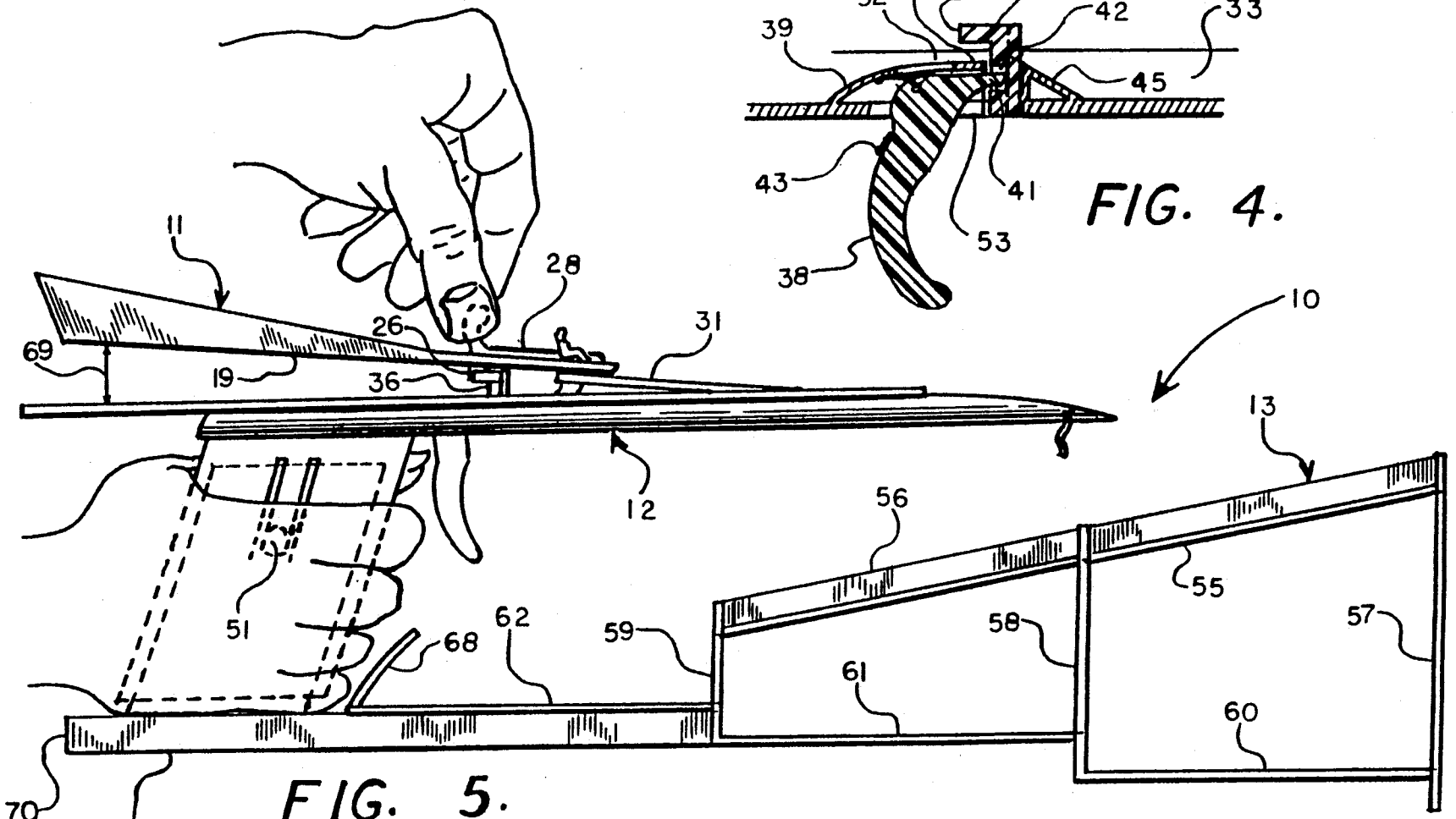
FIG. 5 is a side plan view of the glider being loaded on the launcher with the target attached.

FIG. 1 and FIG. 5 illustrates the target 13, which is made up of rectangular frames staggered in size from the larger front frame 57 to the medium sized middle frame 58 and smaller rear frame 59. The frames do not necessarily have to be rectangular, they can be round or any other staggered size shape in a somewhat funnel effect. A series of platforms 60, 61, 62 connect the base of the frames 57, 58, 59 in step formation, step 66 at frame 58 and step 67 at frame 59, to the smaller rear apex 68. The apex 68 can take any shape, possibly a cylinder shape to simulate a space station module but its main purpose is to prevent a bullseye glider from passing through the target. Frame 57 is larger than 58 by an amount large enough to allow the step 66 configuration at frame 58 to continue around its sides and top and frame 58 is larger than 59 to allow step 67 at frame 59 to continue around its sides and allow the target to be molded in one unit and large enough not to be too difficult or too easy for the user to catch the incoming glider 11. The step formation of the frames act as an obstruction to the flight path of the glider 11. A step formation can also be achieved by diecutting open notches in a smooth somewhat funnel shaped target. The glider 11 hitting anyone of the step configuration of the target will stop at that point or bounce back possibly out of the target. Platforms 60, 61 and 62 are of just sufficient length to hold the glider in its final resting place. Numbers 63, 64, 65 are affixed to the center of each platform 60, 61, 62 in ascending order as they approach the apex indicating the scoring skill of the user when aligning the target and the glider. Holding the frames 57, 58 and 59 parallel to each other and in vertical and horizontal alignment to each other and perpendicular to the platforms 60, 61, 62 is spine member 56 connecting the center of each of the top frame members to each other and in other similar designs to the center of the top of the apex 68. Below the spine member and running along the inside top center of frames 57, 58, and 59 is a somewhat wider spine member 55 which acts as a guide for the glider 11 if it should enter frame 57 somewhat too high but properly centered. The glider 11 nose making contact with the wider spine member 55 will slide down the wider spine 55 easily passing the upper steps on frames 58 and 59 and reaching the apex 68 for the highest score, similar to an ace in tennis. The top surface of an alternate funnel shape design will have the same affect as the wide spine member 55. Extending behind the apex 68 is leg member 71 affixed to the top of it and extending upwards a pair of projecting clips 35. The pair of clips 35 match the angle and the size of the hollow opening 34*a* of the launcher 12 pistol handle 34. When clips 35 are clipped into the handle 34 button 50 thereon locks against the clip release button 51 on the handle 34 and holds the target 13 to the launcher 12. Pressing the clip release button 51 allows the target 13 to be removed from the launcher 12. Clips 35 are located just far enough behind the apex 68 to allow the users hand to comfortable hold the launcher 13 pistol grip 34 without pushing against the apex 68. The target can be attached to the launcher by other means than clipping into the handle. The outer trailing edges 46 of the launcher are of a length that extends past the tail of the glider when loaded and acts as a tripod enabling glider 11 when loaded on the launcher 12 and when connected to the target 13 to be stored in an upright position with the launcher 12, the glider 11 and the target 13 pointing upwards towards the ceiling without the glider tail resting on the supporting surface.

As illustrated in FIG. 5 the glider 11 when loaded on the launcher 12 presses against the trigger pin 36 causing the wing 19 to flex upwards towards the T-rod 28 and the trigger engaging pin 26 to project below the bottom surface of the wing 19 and engage the trigger pin 36. When launched the trigger engaging pin immediately retracts into the wing 19 and passes over the rubber band 31 without snagging it. In the loaded position the space 69 between the glider and the launcher is almosts parallel and somewhat apart from the launcher with no part of the glider touching the launcher except at the trigger pin 36 and rubber band 31. As the trigger is pulled the glider is pulled closer to the launcher and more parallel to it but wing 19 still makes no contact with the launcher and the concave top surface of the barrel 33 is deep enough so that the nosepiece rubber band hook 27 also does not make contact with the launcher.

While there has been shown and described a preferred embodiment, it is to be understood that various other adaptations and modifications may be made within the spirit and scope of the invention.

I claim as my invention:

1. A flying game comprising in combination:

a) (A) a toy glider including a thin plastic unitary planar swept back delta wing having parallel plane top and bottom surfaces of uniform thickness defining a uniform cross-section, lateral distal ends of said wing tapering upwards and extending from a leading edge of the wing to a trailing edge of the wing and being parallel to each other and a longitudinal axis of the glider and defining laterally extending thin planar stabilizers of the same thickness as the wing, individual ailerons integrally formed at the trailing edge of said wing along a horizontal surface, located in a forward part of said wing and having an independent plastic nosepiece attached thereto; and b) (A) a launching device having a short length channel of concave configuration, with resilient means of a rubber band mounted to a front end of the device, a pistol grip mounted to a rear of the device and extending downwards therefrom, the pistol grip having a pivotally mounted trigger with trigger means protruding upwards into the channel and being spring activated to return to a load position after each launch.

2. The flying game of claim 1 wherein the glider is a lightweight glider which can be repeatedly aimed and power launched on the same predetermined trajectory and caught by the user on a target affixed to the launching device so that the target will not interfere with aiming and launching of the glider and be hand held and manipulated by the user to align with an anticipated trajectory of the glider, the glider will contact the target while still in flight and the target will hold the glider in position where the glider made contact with the target, said position indicating by score the skill of the user in aiming the launcher and manipulating the target.

3. The flying game of claim 2, and further comprising a target device including:

a means for scoring which depends on a depth of penetration of the target by whatever is aimed at it or caught by it, a series of thin planar concentric frames each having openings of the same shape but being progressively smaller and staggered one behind the other in a descending order, a series of platforms at a base of the openings for connecting a top of the base of a forward frame to a bottom of the base of the frame behind it, the platforms being essentially horizontal, the rearmost platform being connected to the apex of the target, a number affixed at the center of each platform indicating a score, a straight, narrow spine member running through a center line at the top of each frame starting at the foremost frame and tapering down along tops of the frames, and a clipping mechanism extending upwards from the rear of the target behind the apex.

4. The flying game of claim 1, wherein the wing with said stabilizers is formed from one of a single thin extruded styrofoam sheet of uniform density and an aerodynamic uniform density cellular plastic material, a substantially rounded nose is provided along the horizontal plane of the leading edge of the wing, said stabilizers are angled upwards substantially closer to the longitudinal axis, the wing has a configuration, with the substantially rounded nose and the stabilizers of U configuration, said rounded nose is further curved upwards around the entire leading edge to form a fillet joining the leading ends of the stabilizers completing a U shaped structural frame, said individual ailerons are integrally formed on each side of the trailing edge of said wing with said ailerons preset in an upwards position, apertures are centrally located in the forward part of said wing, said nosepiece being an independent rigid plastic nosepiece positioned behind the leading edge and essentially forward of a center of lift and center of gravity of said wing and said nosepiece in combination.

5. The flying game of claim 3, wherein the leading edge of the wing along the horizontal plane extends in an enlarged arc tangentially from one side of the swept back delta wing to the other side.

6. The flying game of claim 3, wherein the stabilizers extend from the leading edge of said wing to the trailing edge, parallel to the longitudinal axis closer to the longitudinal axis meeting the forward edge of the wing and closer to the ends of said arc of the rounded nose increasing the length and height of said stabilizers.

7. The flying game of claim 3, wherein said rounded nose and said stabilizers essentially change said wing configuration to a U shaped configuration along the horizontal plane.

8. The flying game of claim 3, wherein said stabilizers are located closer to the longitudinal axis and are inclined outward from a vertical axis of the glider imparting additional stability to said glider in flight.

9. The flying game of claim 3, wherein said fillet around the leading edge acts as a flexible bumper providing additional impact area and compression means to soften the impact with the eye of a person.

10. The flying game of claim 1, and further comprising a trigger mechanism with a trigger pin; a hollow pistol handle extending below and to a rear of said channel and wherein a clip can be inserted in the handle and locked into place, and a spring activated button is provided on the handle to release the clip for removal.

11. The flying game of claim 10 wherein the clip when inserted into the pistol handle is affixed to a target.

12. The flying game of claim 10, wherein the trigger mechanism includes:

a trigger pin;

a trigger pivoting means; and a trigger pin guidance channel.

13. The flying game of claim 12 wherein a horizontal broad v projection of the trigger pin is molded atop of and perpendicular to a short, flat length of rigid plastic material with a flat surface vertical to the v and with a rectangular aperture cut out in the flat surface and located just beneath a point of the v and through to the other side in the longitudinal direction of the v.

14. The flying game of claim 12 wherein a trigger is connected to the trigger pin by a gear type protrusion from the trigger positioned forward of a pivot point of the trigger and fitting into a cutout formed in the trigger pin.

15. The flying game of claim 12 wherein the trigger pin slides vertically down and up in a guidance channel thereof each time a trigger is pulled and released.

16. The flying game of claim 1, and further comprising a launching mechanism including:

a horizontal open end channel of an upwards facing concave configuration, said channel containing a pair of wedge-shaped slits at a front thereof, a rubber band resilient means locked in said wedge-shaped slits, and a launcher for launching the glider.

17. An ultra-light toy glider comprising a thin low density cellular plastic unitary planar wing of swept back delta configuration and having parallel plane top and bottom surfaces, said wing having a substantially rounded leading edge along a horizontal plane extending in an arc tangentially from one side of the wing to the other side thereof, a rounded nose, lateral end stabilizers extending from the leading edge of the wing to a trailing edge, parallel to a longitudinal axis and positioned substantially closer to the longitudinal axis meeting the forward edge of the the wing and being substantially closer to the ends of said rounded nose, said leading edge being further configured with an upward curved fillet extending around the entire arc and blending with the forward end of said stabilizers providing a U frame around the horizontal planar surface, individual ailerons integrally formed at the trailing edge of said wing along the horizontal surface and being preset to determine the trajectory of said glider, said wing having apertures centrally located in the forward part of said wing, a rigid plastic nosepiece positioned behind the leading edge of said wing and forward of the center of gravity of said wing and said nosepiece combined, said nosepiece having, in one unitary molded piece, depending projections, and means for absorbing and distributing the stresses on said wing during loading and on launch and impact.

18. The ultra-light glider of claim 17, wherein said plastic nosepiece is of a material having a substantially greater density and strength than the plastic material forming said wing, said nosepiece including:

a finger grip, a rubber band engaging hook, a trigger engaging pin, a load distributing fastening projection, and an adjustable weight attachment and locking means.

19. The ultra-light glider of claim 18, wherein said finger grip can engage said rubber band hook with a rubber band and can pull back said hook against resilience of the rubber band until said trigger engaging pin protruding from the bottom of the nosepiece can engage a trigger pin on a launcher.

20. The ultra-light glider of claim 18, wherein said finger grip and said hook absorb all resilient tension of the rubber band during a loading procedure without any tension being transmitted to said wing.

21. The ultra-light glider of claim 18, wherein said trigger engaging pin engages a trigger pin on a launcher and when engaged said trigger engaging pin is connected to said rubber band hook to absorb all resilient tension of the rubber band without any tension being applied to said wing.

* * * * *